US006640402B1

(12) United States Patent
Vooren et al.

(10) Patent No.: US 6,640,402 B1
(45) Date of Patent: Nov. 4, 2003

(54) METHOD OF MANUFACTURING AN INK ACTUATOR

(75) Inventors: Colby Van Vooren, Corvallis, OR (US); Timothy L. Weber, Corvallis, OR (US); Colin C. Davis, Corvallis, OR (US); Naoto Kawamura, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 511 days.

(21) Appl. No.: 09/628,412

(22) Filed: Aug. 1, 2000

(65) Prior Publication Data

(65)

Related U.S. Application Data

(63) Continuation of application No. 09/070,826, filed on Apr. 30, 1998, now Pat. No. 6,126,273.

(51) Int. Cl.[7] ..... H04R 17/00

(52) U.S. Cl. ..... 29/25.35; 29/846; 29/847; 29/890.1; 216/27; 438/21

(58) Field of Search ..... 29/25.35, 846, 29/847, 890.1, 8, 31, 830; 347/20, 68, 70, 54; 216/27; 438/21

(56) References Cited

U.S. PATENT DOCUMENTS

| | | | | |
|---|---|---|---|---|
| 4,535,343 A | | 8/1985 | Wright et al. | 346/140 R |
| 4,695,853 A | | 9/1987 | Hackleman et al. | 346/140 R |
| 4,917,286 A | | 4/1990 | Pollacek | 228/110 |
| 4,951,063 A | * | 8/1990 | Hawkins | 346/1.1 |
| 5,061,985 A | * | 10/1991 | Meguro | 357/68 |
| 5,278,584 A | | 1/1994 | Keefe et al. | 346/140 R |
| 5,459,501 A | * | 10/1995 | Lee | 347/68 |
| 5,581,861 A | | 12/1996 | Lee et al. | 29/25.35 |
| 5,606,351 A | * | 2/1997 | Hawkins | 347/15 |
| 5,666,141 A | | 9/1997 | Matoba et al. | 347/54 |
| 5,804,083 A | | 9/1998 | Ishii et al. | 347/54 X |
| 5,856,837 A | | 1/1999 | Kitahara et al. | 347/70 |
| 6,013,160 A | * | 1/2000 | Raisanen | 204/192.15 |

FOREIGN PATENT DOCUMENTS

| | | | |
|---|---|---|---|
| DE | 3427850 A1 | 7/1984 | B41J/3/04 |
| DE | 4429904 A1 | 8/1994 | B41J/2/14 |
| EP | 713774 A2 | 5/1996 | 347/54 |
| JP | 60036175 | 2/1985 | B41J/3/04 |
| JP | 60038163 | 2/1985 | B41J/3/04 |
| JP | 890769 | 4/1996 | 347/54 |
| JP | 8142323 | 6/1996 | 347/54 |
| JP | 91795 | 1/1997 | 347/54 |

OTHER PUBLICATIONS

S. Egawa & T. Higuchi, "Multi–Layered Electrostatic film Actuator", IEEE Micro Electro Mechanical Systems, Feb. 11–14, 1990, pp. 166–171.

(List continued on next page.)

*Primary Examiner*—Carl J. Arbes
*Assistant Examiner*—Tai Nguyen

(57) ABSTRACT

An inkjet printer printhead utilizes a substrate, an orifice layer, and a directionally biased electrostrictive polymer ink actuator disposed between the orifice layer and the substrate to eject ink from the printhead. The electrostrictive polymer ink actuator has a passivation layer disposed on the substrate, a first compliant electrode disposed at least on a first portion of the passivation layer, an electrostrictive polymer membrane disposed on a first area of the first compliant electrode, a passivation constraint disposed on a second portion of the passivation layer and a second area of the first compliant electrode effectively surrounding, in contact with, but not covering the electrostrictive polymer membrane in the first area of the first compliant electrode, and a second compliant electrode disposed on the passivation constraint which is disposed on the second portion of the passivation layer and the electrostrictive polymer membrane which is disposed on the first area of the first compliant electrode.

10 Claims, 7 Drawing Sheets

OTHER PUBLICATIONS

J. Scheinbeim & B. Newman, Z. Ma, "Electrostrictive Response Of Elastomeric Polymers", ASC Polymer Reprints, 1992, vol. 33, Issue 2, pp. 385–386.

R. Pelrine, R. Kornbluh, J. Joseph, S. Chiba, "Artificial Muscle Actuator", International Micromachine Symposium, Nov. 1–2, 1995, pp. 143–146.

J. Aden, J. Bohorquez, D. Collins, M. Crook, A. Garcia, U. Hess, "The Third–Generation HP Thermal InkJet Printhead" Hewlett–Packard Journal, Feb. 1994, pp. 41–45.

R. Askeland, W. Childers, W. Sperry, "The Second–Generation Thermal InkJet Structure" Hewlett–Packard Journal Aug. 1988, pp. 28–31.

G. Siewell, W. Boucher, P. McClelland, "The ThinkJet Orifice Plate: A Part With Many Functions", Hewlett–Packard Journal, May 1985, pp. 33–37.

E. Bhaskar, J. Aden, "Development of the Thin–Film Structure for ThinkJet Printhead", Hewlett–Packard Journal, May 1985, pp. 27–33.

R. Pelrine, R. Kornbluh, J. Joseph, S. Chiba, "Electrostriction Of Polymer Films For Microactuators", IEEE Micro Electro Mechanical Systems, Jan. 26–30, 1997, pp. 238–243.

* cited by examiner

METHOD OF MANUFACTURING AN INK ACTUATOR

CROSS REFERENCE TO RELATED APPLICATIONS

This is a (X) continuation of application Ser. No. 09/070,826 now U.S. Pat. No. 6,126,273 filed on Apr. 30 1998.

BACKGROUND OF THE INVENTION

This invention relates to print cartridges for inkjet printers and more specifically to the expulsion of ink from an inkjet printer printhead.

Inkjet printing mechanisms use pens that shoot droplets of colorant onto a printable surface to generate an image. Such mechanisms may be used in a wide variety of applications, including computer printers, plotters, copiers, and facsimile machines. For convenience, the concepts of the invention are discussed in the context of a printer. An inkjet printer typically includes a printhead having a plurality of independently addressable firing devices. Each firing device includes a firing chamber connected to a common ink source, an ink propulsion device, and an ink expulsion nozzle. The ink propulsion device within the firing chamber provides the impetus for expelling ink droplets through the nozzles.

In thermal inkjet pens, the ink propulsion device is a resistor that provides sufficient heat to rapidly vaporize a small portion of ink within the firing chamber. The bubble expansion provides for the displacement of a droplet of liquid ink from the nozzle. The heat to which the ink is exposed in a thermal ink jet pen prevents the use of thermally unstable ink formulations that might otherwise provide desirable performance and value. Therefore, the available ink options are reduced to those that are not adversely affected by varying temperatures.

Conventional piezoelectric inkjet pens avoid the disadvantages of thermally stressing the ink by using a piezoelectric transducer in each firing chamber. The firing chamber dimensionally contracts in response to the application of a voltage to provide the displacement to expel a droplet of ink having a volume limited to the volume change of the piezoelectric material. Because of the very low displacement or equivalent strains (<1%) of piezoelectric material, conventional piezoelectric transducers have limited volume displacement capability requiring relatively large crystals thereby reducing packing density. Furthermore, piezoelectric transducers are susceptible to degradation by direct exposure to some inks that might otherwise be desirably employed, and have other disadvantages related to limited miniaturization, cost, and reliability.

With the invention as described hereinafter, an ink expulsion actuator is manufacturable that has increased ink flexibility; is a more predictable and repeatable actuator by the elimination of thermal cycling used in conventional inkjet propulsion systems which eliminates unpredictable ink nucleation variations; and, allows discrete control of ink drop size through the control of voltage due to the increased displacement or strain (up to 30%) of electrostrictive polymer actuators over piezoelectric devices.

SUMMARY OF THE INVENTION

An inkjet printer printhead utilizes a substrate, an orifice layer, and a directionally biased electrostrictive polymer ink actuator disposed between the orifice layer and the substrate. The electrostrictive polymer ink actuator has a passivation layer disposed on the substrate, a first compliant electrode disposed at least on a first portion of the passivation layer, an electrostrictive polymer membrane disposed on a first area of the first compliant electrode, a passivation constraint disposed on a second portion of the passivation layer and a second area of the first compliant electrode effectively surrounding, in contact with, but not covering the electrostrictive polymer membrane in the first area of the first compliant electrode, and a second compliant electrode disposed on the passivation constraint which is disposed on the second portion of the passivation layer and the electrostrictive polymer membrane which is disposed on the first area of the first compliant electrode.

BRIEF DESCRIPTION OF THE DRAWINGS

The present invention can be further understood by reference to the following description and attached drawings, which illustrate the preferred embodiment.

DETAILED DESCRIPTION OF THE PREFERRED EMBODIMENT

Figure 1:
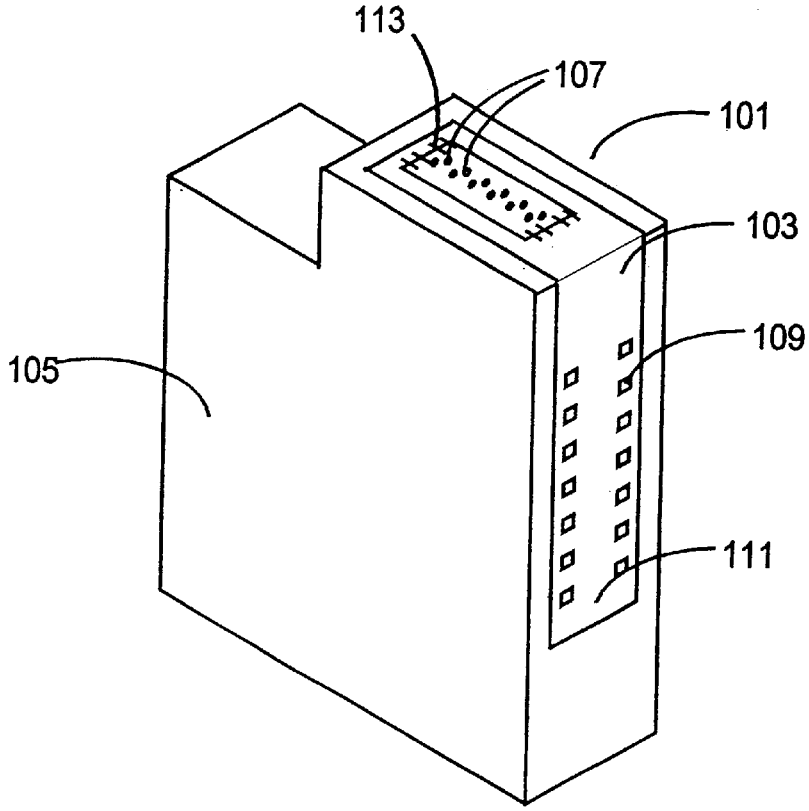
FIG. 1 is a perspective view of an inkjet printer print cartridge according to one embodiment of the present invention.

Referring to FIG. 1, reference number 101 generally indicates an inkjet printer print cartridge incorporating a printhead according to one embodiment of the present invention. Inkjet printer print cartridge 101 includes ink reservoir 105, which holds the ink prior to expulsion, and printhead assembly 103, where printhead assembly 103 is formed using Tape Automated Bonding (TAB) techniques. One conventional technique is described in U.S. Pat. No. 4,917,286 (Pollacek). Printhead assembly 103 (hereinafter "TAB head assembly 103")includes ink expulsion nozzles 107 formed on substrate 201. An alternate embodiment of the invention (not shown) has the ink expulsion nozzles 107 formed in flexible circuit 111 by, for example, laser ablation.

Figure 2:
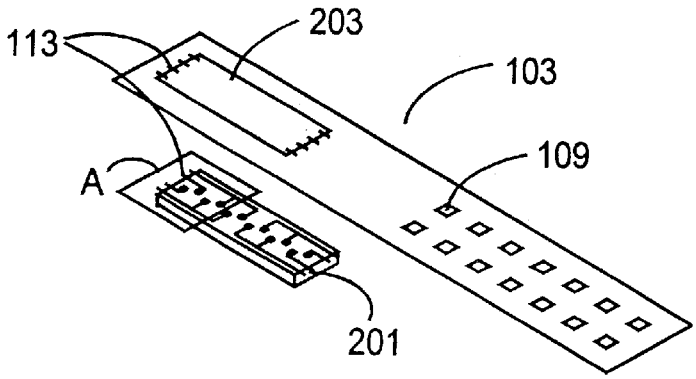
FIG. 2 is a perspective view of the top surface of the Tape Automated Bonded (TAB) printhead assembly (hereinafter "TAB head assembly")removed from the print cartridge of FIG. 1 and exposing the printhead.

A back surface of flexible circuit 111 includes conductive traces (not shown) formed thereon, for example, using a photolithographic etching and/or plating process. Printer contact pads 109, designed to interconnect with a printer, terminate these conductive traces on one end. The opposite ends are terminated, via TAB bond beams 113, on a substrate 201 containing ink expulsion devices (FIG. 2). Inkjet printer print cartridge 101 is designed to be installed in a printer so that contact pads 109, on the front surface of flexible circuit 111, contact printer electrodes providing externally generated energization signals to TAB head assembly 103 to command firing of the desired ink expulsion device.

FIG. 2 is a perspective view of the top surface of a TAB head assembly 103 removed from inkjet printer print cartridge 101 of FIG. 1 and straightened out. Affixed to TAB head assembly 103 via TAB bond beams 113 through a TAB bond window 203 opening through the flexible circuit 111 is a semiconductor substrate 201 containing a plurality of individually energizable ink propulsion devices. Each ink propulsion device is fluidically coupled to a single ink expulsion nozzle 107 and expels a droplet of ink when selectively energized by one or more pulses or instructions applied to one or more contact pads 109. The ink is supplied from ink reservoir 105 (FIG. 1). An alternate embodiment is contemplated where the ink is supplied from a remote ink reservoir connected to ink jet printer print cartridge 101 by a tube. In the preferred embodiment, the individually energizable ink propulsion devices are electrostrictive polymer actuators that are contained on the silicon substrate 201.

Figure 3:
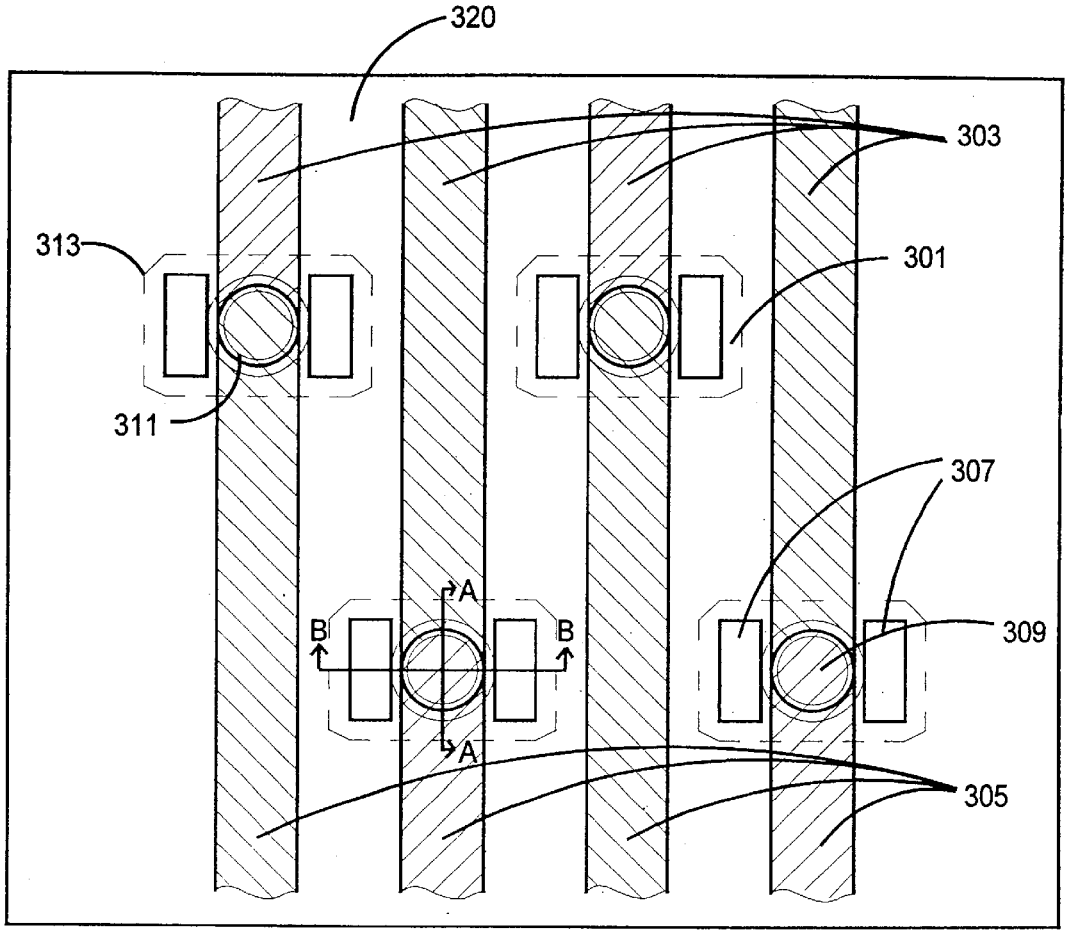
FIG. 3 is a view A from FIG. 2, expanded for clarity and a better perspective of the points of cross sectioning for FIG. 6A, 6B and 7.
Figure 6A:
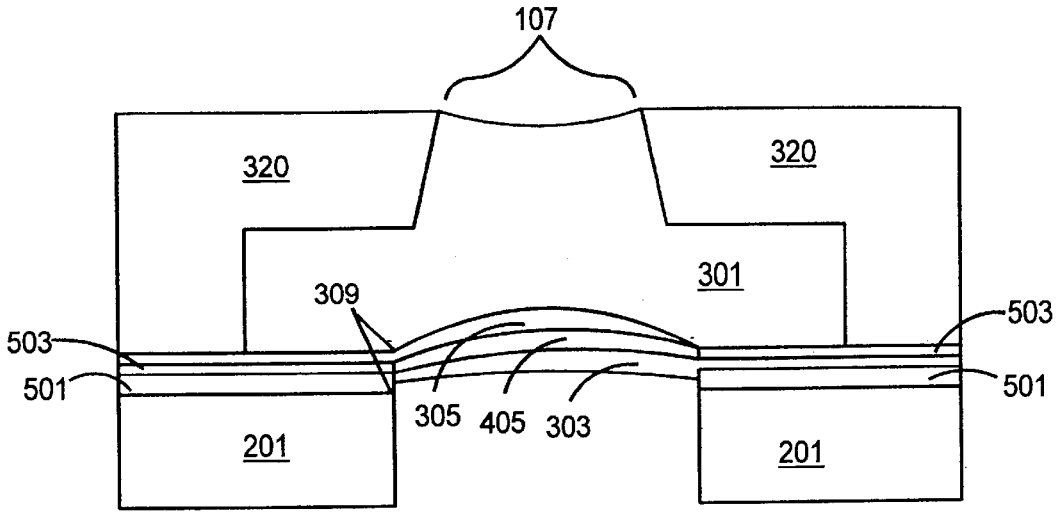
FIG. 6A and 6B are side elevation views in a cross-section taken along line A—A in FIG. 3 illustrating the relationship of the electrostrictive polymer ink propulsion device with respect to the layered components on a substrate on a TAB head assembly.
Figure 6B:
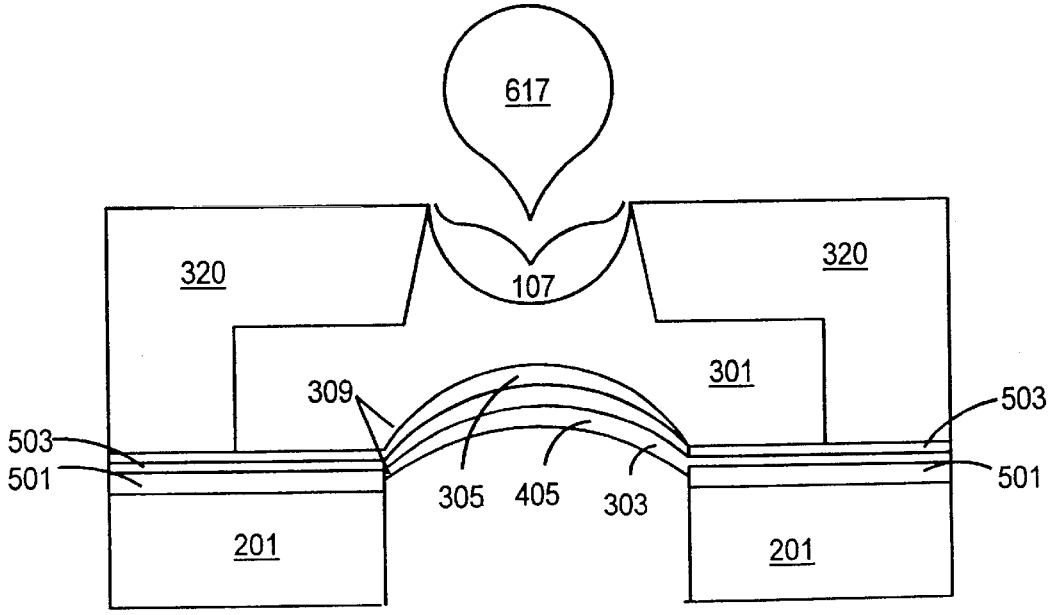
Figure 7:
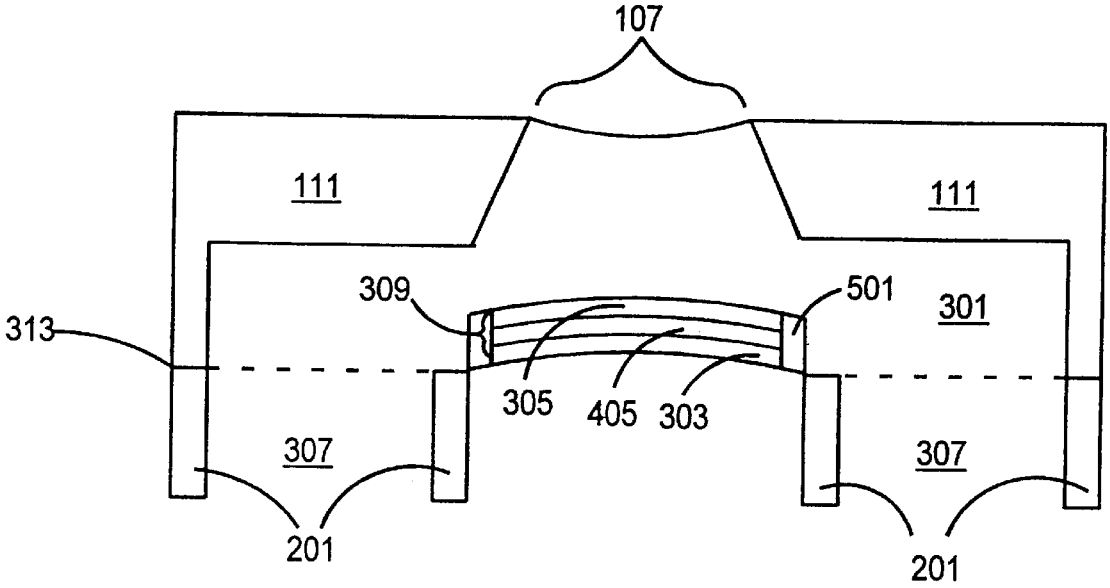
FIG. 7 is a side elevation view in a cross-section taken along line B—B in FIG. 3 illustrating the relationship of the electrostrictive polymer ink propulsion device and the ink feed into the device with respect to the layered components on a substrate on a TAB head assembly.

FIG. 3 is a detailed view A from FIG. 2, expanded for clarity and a better perspective of the points of cross sectioning A—A and B—B which are detailed in FIG. 6A, 6B and 7. FIG. 3 provides a detailed top plan view of substrate 201 and the first four firing chambers 301 corresponding to the first four ink expulsion nozzles 107. Each firing chamber 301 contains an electrostrictive polymer ink propulsion device 309 and associated first compliant electrode 303 and second compliant electrode 305. These two electrodes overlap to create the circular shaped electrostrictive polymer ink A propulsion device 309 as shown. Although this device is pictured in a circular shape, it has been contemplated to make the devices other shapes such as oval or rectangular, depending upon the properties of the materials used and the desired response of the ink. Interposed between first compliant electrode 303 and second compliant electrode 305 is an electrostrictive polymer membrane.

The top surface of FIG. 3 is orifice layer 320. Orifice layer 320 has the ink expulsion nozzles 107 defined in it and is the top, or ceiling, of firing chamber 301. Ink feed channels 307 extend through substrate 201, but not through orifice layer 320. Ink feed channel 307 works as an ink supply duct between ink reservoir 105 and firing chamber 301 in order to supply ink to electrostrictive polymer ink propulsion device 309. With orifice layer 320 atop substrate 201, each ink expulsion nozzle 107, in the preferred embodiment, would have an ink chamber entrance 313 and an ink chamber exit 311 defined in orifice layer 320 that would be aligned in a manner similar to that shown in FIG. 3. Other embodiments have been contemplated where electrostrictive polymer ink propulsion device 309 is not in direct alignment with ink expulsion nozzle 107, yet fluidically coupled thereby expulsion of ink is a result of a sudden decrease in the volume of firing chamber 301.

Figure 4A:
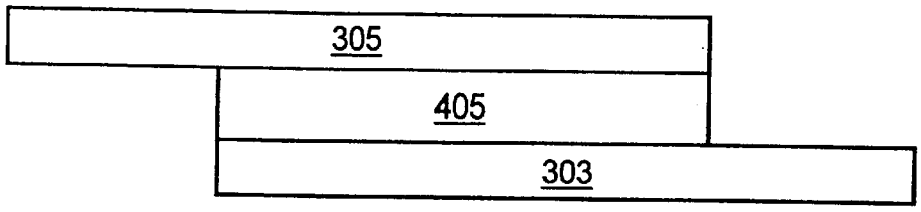
FIG. 4A and 4B are illustrations of the basic structure of an embodiment of the invention in an unactuated (4A) and an actuated (4B) state.
Figure 4B:
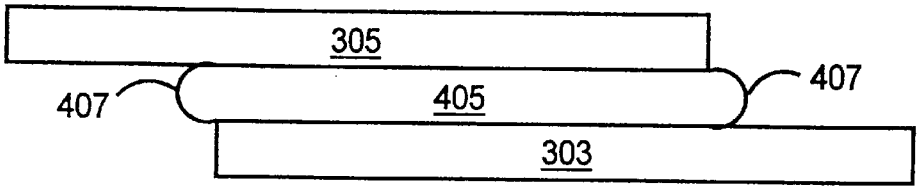

FIG. 4A and 4B are illustrations of the basic structure of an embodiment of the invention in a power off (FIG. 4A) and a power on (FIG. 4B) state. The first compliant electrode 303 and the second compliant electrode 305 together act as a parallel plate capacitor in the area where they overlap. In the overlapped area there is interposed an electrostrictive polymer membrane 405. This overlapped area forms an electrostrictive polymer ink propulsion device 309. When a voltage difference is applied between first compliant electrode 303 and second compliant electrode 305, electrostrictive polymer membrane 405 is squeezed in thickness and stretched in length and width. Due to the otherwise incompressible nature of electrostrictive polymer materials, electrostrictive polymer membrane 405 will expand in an unconstrained way in an effort to conserve total volume. This is illustrated in FIG. 4B by polymer membrane bulges 407.

Figure 5A:
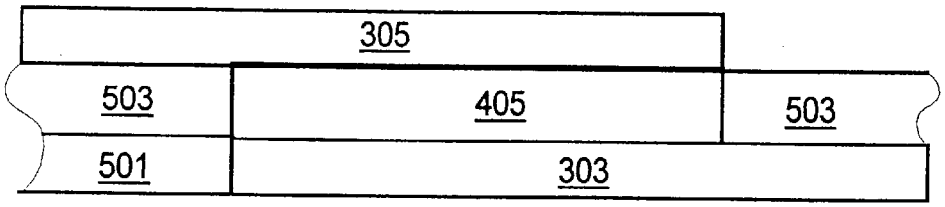
FIG. 5A and 5B are illustrations of the basic structure of the preferred embodiment of the invention in an unactuated (5A) and an actuated (5B) state.
Figure 5B:
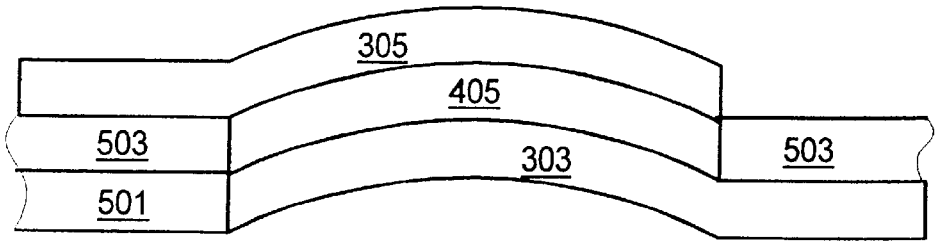

In FIG. 5A and 5B, passivation constraint 503 is added to constrain electrostrictive polymer membrane 405 from expanding in a horizontal direction upon actuation. FIG. 5B illustrates the squeezing and stretching of electrostrictive polymer membrane 405 when a voltage difference is applied between first compliant electrode 303 and second compliant electrode 305. Instead of expanding horizontally as shown in FIG. 4B, the flexible properties of first compliant electrode 303 and second compliant electrode 305, coupled with horizontal constraint provided by passivation constraint 503, the layers are forced to buckle into a domed shape as depicted in FIG. 5B. The action created by alternating between the powered off state in FIG. 5A and the powered on state of FIG. 5B creates the actuating movement of electrostrictive polymer ink propulsion device 309 of FIG. 3.

The cross-sectional view of a firing chamber 301 at line A—A of FIG. 3 is shown in FIG. 6A. This view shows the relative positions of substrate 201, passivation layer 501 and passivation constraint 503, first compliant electrode 303, electrostrictive polymer membrane 405, second compliant electrode 305 and orifice layer 320. The layering area common to first compliant electrode 303, electrostrictive polymer membrane 405, and second compliant electrode 305 defines electrostrictive polymer ink propulsion device 309. FIG. 6A is an illustration of electrostrictive polymer ink propulsion device 309 in an unactuated state with firing chamber 301 filled with ink at rest within ink expulsion nozzle 107. In the preferred embodiment of the invention, electrostrictive polymer ink propulsion device 309 is slightly curved in order to precamber or bias electrostrictive polymer ink propulsion device 309 to assure expulsion of the ink droplet in the direction of ink expulsion nozzle 107. The ink stays within firing chamber 301 when unactuated due to surface tension at ink expulsion nozzle 107 and backpressure in the ink delivery system of ink reservoir 105. FIG. 6B depicts electrostrictive polymer ink propulsion device 309 in an actuated state with the ink held within firing chamber 301 being forced out of ink expulsion nozzle 107 by the volume displacement in firing chamber 301. This displacement is created by the actuating movement of the electrostrictive polymer ink propulsion device 309 buckling toward the ink expulsion nozzle 107 thereby creating and shooting ink droplet 617 onto the media beyond.

The cross-sectional view of firing chamber 301 at line B—B of FIG. 3 is shown in FIG. 7. Ink channels 307 are excavated through substrate 201 on both sides of electrostrictive polymer ink propulsion device 309. The ink chamber entrance 313 is of a size large enough to encompass both ink channels 307 and electrostrictive polymer ink propulsion device 309. Ink is supplied to electrostrictive polymer ink propulsion device 309 from ink reservoir 105. The ink flows through ink feed channels 307, into ink firing chamber 301 and ultimately into ink expulsion nozzle 107 to await expulsion by electrostrictive polymer ink propulsion device 309. Other embodiments of this system have been contemplated where orifice hole 107 and its associated ink nozzle 607 are located on a side wall of firing chamber 301 rather than the top wall, or ceiling, of firing chamber 301.

Figure 8A:
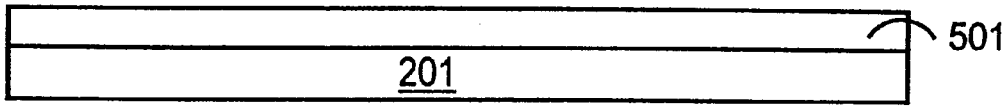
FIG. 8 is an illustration of a process flow for building the electrostrictive polymer ink propulsion device of the preferred embodiment of the invention.
Figure 8B:
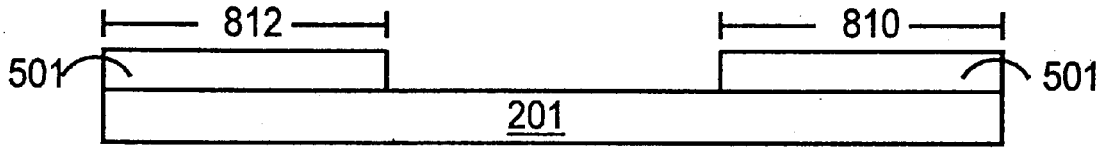

FIG. 8A through 8H illustrate the steps to construct an electrostrictive polymer ink propulsion device 309 in the preferred embodiment of the invention. The fabrication of an electrostrictive polymer ink actuator for an inkjet printer pen may be performed on a scale small enough to create small pitch nozzle arrays using current photolithography patterning techniques. Another embodiment of the present invention fabricates an electrostrictive polymer ink actuator using thin film deposition and patterning techniques such as suggested in HP Journal, May 1985, pg. 27 or pg. 35; HP Journal, August 1988, pg. 28; and HP Journal, February 1994, page 41. FIG. 8A shows the initial step of spin coating a first layer of passivation constructing passivation layer 501 to a substrate 201. The passivation layer is then patterned by application of a photo-chemically reactive resist, masking the desired shape, electromagnetic radiation exposure, and finally etching in the shape of the perimeter of electrostrictive polymer ink propulsion device 309 as depicted by FIG. 8B.

Figure 8C:
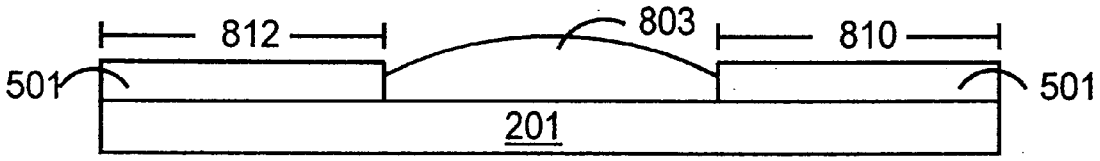

Next, in FIG. 8C illustrates the preferred embodiment of the invention where a sacrificial photoresist bump 803 is formed in the area of the removed passivation shown in FIG. 8B. Photoresist bump 803 is constructed by spinning on the photoresist material, patterning the material in the desired shape, then heating the photoresist material so that it reflows in a slightly "domed" shape. This shape is the foundation shape of the electrostrictive polymer ink propulsion device 309. By forming photoresist bump 803 in a dome, when electrostrictive polymer ink propulsion device 309 is actuated, the domed shape will act as a bias, or precamber, that will promote the buckling and displacement (see FIG. 6A and 6B) to occur in the direction of ink expulsion nozzle 107, in order to expel ink droplet 617 onto the media beyond. Other methods of biasing have been contemplated such as pre-stressing the layers of the electrostrictive polymer ink propulsion device 309, inducing differing fluidic pressures on either side of the device, inducing differing horizontal compressive forces in each compliant electrode or patterning the surface of the substrate prior to the first layer. Each of these alternatives would encourage the electrostrictive polymer ink propulsion device 309 to buckle in the direction of least resistance, as opposed to an arbitrary direction.

Figure 8D:
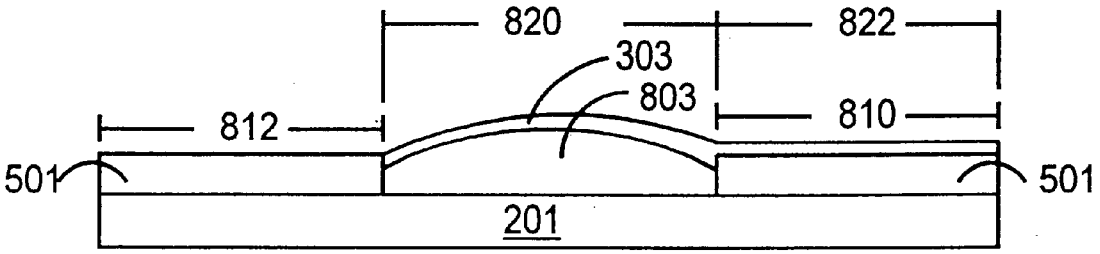
Figure 8E:
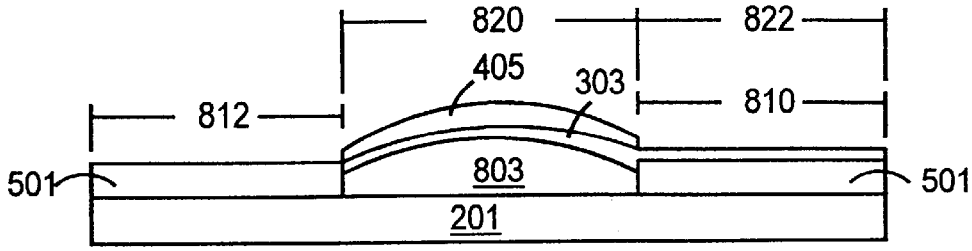

In FIG. 8D, an electrically conductive first compliant electrode 303 is spun on atop and conforming to photoresist bump 803. As illustrated in FIG. 3, first compliant electrode 303 is patterned in a strip that terminates in the shape of one half the exterior shape defined by electrostrictive polymer ink propulsion device 309. In the preferred embodiment of the invention, this shape is a semicircle. The shaped end of first compliant electrode 303 is adjacent to passivation layer. FIG. 8E shows electrostrictive polymer membrane 405 constructed directly above photoresist bump 803 while first compliant electrode 303 is between electrostrictive polymer membrane 405 and photoresist bump 803. Electrostrictive polymer membrane 405 is of approximately the same shape and size as photoresist bump 803.

Figure 8F:
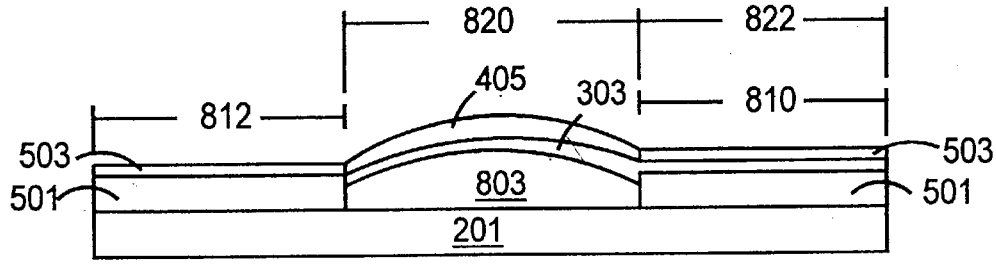
Figure 8G:
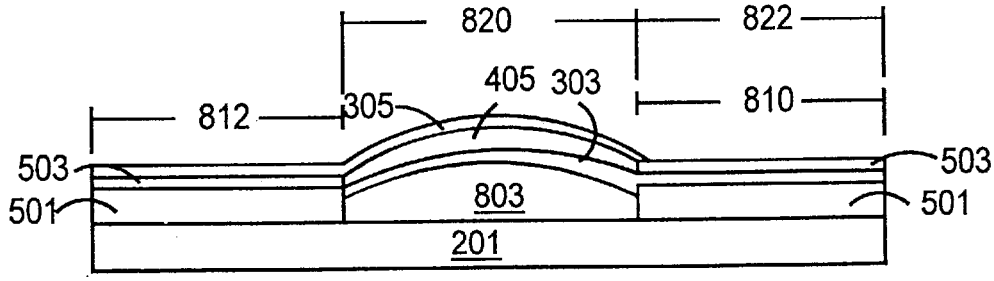

In FIG. 8F, passivation constraint 503 layer is deposited in a fashion similar to that used for passivation layer 501 and patterned to act as a mechanical constraint for electrostrictive polymer membrane 405 forcing it to buckle, rather than horizontally bulge, when deformed. In FIG. 8G, second compliant electrode 305 is layered atop electrostrictive polymer membrane 405 and terminated in the same shape as first compliant electrode 303, covering electrostrictive polymer membrane 405, but extending outward a direction opposite that of first compliant electrode 303 as illustrated in FIG. 3. The overlapped layers of first compliant electrode 303, and second compliant electrode 305 with electrostrictive polymer membrane 405 interposed between the two compliant electrodes, forms electrostrictive polymer ink propulsion device 309.

Figure 8H:
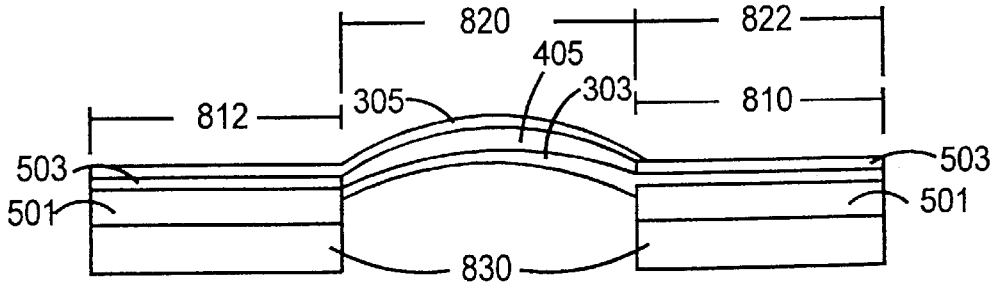

In FIG. 8H, photoresist bump 803 is removed by excavating, for example by laser ablation, through substrate 201 and photoresist bump 803, leaving the layers of first compliant electrode 303, electrostrictive polymer membrane 405, and second compliant electrode 305 free to move upon actuation.

In the preferred embodiment of the invention, electrostrictive polymer membrane 405, first compliant electrode 303, and second compliant electrode 305 are spin coated on silicon substrate 201 and patterned using conventional masking and etching technology. These electrodes are approximately 0.25 microns thick and approximately 40 microns in width. Passivation layer 501 and passivation constraint 503 are silicon nitride in the preferred embodiment and are approximately 0.5 microns thick. First compliant electrode 303 and second compliant electrode 305 are constructed from ultra-thin gold (100–200 Å) in the preferred embodiment; however, other materials such as carbon fibers and conductive rubber have been contemplated. The ideal electrode would be perfectly compliant and patternable, and could be made thin relative to the electrostrictive polymer membrane 405 thickness.

In the preferred embodiment, electrostrictive polymer membrane 405 is made from a silicone rubber approximately one micron thick and 40 microns in diameter with a Young's modulus of 0.7 Mpa and a dielectric constant of 10. Acceptable variations of silicone rubber for electrostrictive polymer membrane 405 have a thickness of 0.25–2.1 microns, a diameter of 10–70 microns, a Young's modulus of 0.2–2.0 Mpa, and a dielectric constant of 1–14.

The technology of the present invention is comparable to piezoelectric transducers for use in ink drop propulsion. A voltage potential is applied to the actuator resulting in mechanical deformation. In principle it provides similar advantages as piezoelectric over thermal inkjet, such as no thermal cycling, control over drop size (more voltage=more deflection), higher ink independence and more repeatable performance. However, the disclosed invention provides an advantage over piezoelectric transducer in that these electrostrictive polymer materials can supply 30% strains as opposed to the piezoelectric strains of <1%.

In the previously described drawings, a new method and apparatus for ink drop propulsion has been presented that has advantages over current thermal and piezoelectric technology. This invention eliminates thermal cycling used in current thermal inkjet propulsion systems, thereby eliminating unpredictable nucleation variations in the ink. Without concern for the unpredictable ink nucleation due to thermal cycling, flexibility in useable inks and repeatability of drop firing are increased, and the problem of thermal fatigue on thin films is no longer an issue.

What is claimed is:

1. A method of manufacturing an ink actuator for an inkjet printer printhead comprising the steps of:

disposing a passivation layer on a substrate in a first portion and a second portion;

disposing a first compliant electrode on said passivation layer covering said first portion of the passivation layer;

disposing an electrostrictive polymer membrane on said first compliant electrode in a first area;

disposing a passivation constraint on said second portion of said passivation layer and a second area of said first compliant electrode effectively surrounding, in contact with, but not covering said electrostrictive polymer membrane in said first area of said first compliant electrode; and disposing a second compliant electrode on said passivation constraint which is disposed on said second portion of said passivation layer and said electrostrictive polymer membrane which is disposed on said first area of said first compliant electrode and conforming to said electrostrictive polymer membrane.

2. The method of claim 1, further comprising the steps of:

disposing a photoresist bump on said substrate in said first area;

excavating through said substrate; and removing said photoresist bump thereby creating a hole through said substrate extending to said first compliant electrode.

3. A method of manufacturing an ink actuator for an inkjet printer printhead, comprising:

disposing a passivation layer on a substrate in a first portion and a second portion;

disposing a first compliant electrode over the first portion of the passivation layer;

disposing an electrostrictive polymer membrane over a first area of the first compliant electrode, the electrostrictive polymer membrane being directionally biased to deflect in a predefined direction;

disposing a passivation constraint over the second portion of the passivation layer and a second area of the first compliant electrode effectively surrounding, in contact with, but not covering the electrostrictive polymer membrane that is disposed over the first area of the first compliant electrode; and disposing a second compliant electrode over the passivation constraint which is disposed over the second portion of the passivation layer and over the electrostrictive polymer membrane which is disposed over the first area of the first compliant electrode.

4. The method of claim 3, further comprising:

disposing a photoresist bump over the substrate in the first area; and removing the photoresist bump thereby creating a hole through the substrate that extends to the first compliant electrode.

5. The method of claim 3, further comprising:

disposing a photoresist bump over the substrate in the first area;

excavating through the substrate; and removing the photoresist bump thereby creating a hole through the substrate that extends to the first compliant electrode.

6. The method of claim 3, further comprising disposing a photoresist bump over the substrate such that the first area of the first compliant electrode is disposed to be directionally biased in the predefined direction.

7. The method of claim 3, further comprising disposing a photoresist bump over the substrate such that the first area of the first compliant electrode is disposed to be directionally biased in the predefined direction, and such that a first area of the second compliant electrode is disposed to be directionally biased in the predefined direction.

8. The method of claim 3, wherein disposing the passivation constraint includes disposing the passivation constraint to limit a horizontal expansion of the electrostrictive polymer membrane in an event that the electrostrictive polymer membrane is actuated.

9. The method of claim 3, wherein disposing the passivation constraint includes disposing the passivation constraint to force the electrostrictive polymer membrane to deflect in the predefined direction in an event that the electrostrictive polymer membrane is actuated.

10. The method of claim 3, wherein disposing the passivation constraint includes disposing the passivation constraint to force the electrostrictive polymer membrane to buckle in the predefined direction in an event that the electrostrictive polymer membrane is actuated.

* * * * *